US007016640B1

(12) United States Patent
de Koning et al.

(10) Patent No.: US 7,016,640 B1
(45) Date of Patent: Mar. 21, 2006

(54) DOCUMENT HANDLER/SCAN TUB SKEW CORRECTION SYSTEM

(75) Inventors: Petrus T. de Koning, Toronto (CA); Dan V. Ussyshkin, Thornhill (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/150,937

(22) Filed: Jun. 13, 2005

(51) Int. Cl.
*G03G 15/00* (2006.01)

(52) U.S. Cl. ..... 399/367; 399/372; 399/377; 399/379

(58) Field of Classification Search ..... 399/367, 399/377, 379, 380, 372, 144, 151; 358/474, 358/498
See application file for complete search history.

(56) References Cited

U.S. PATENT DOCUMENTS 4,530,598 A * 7/1985 Kajita et al. ..... 355/75
5,003,347 A * 3/1991 Kameda ..... 355/75
6,163,668 A * 12/2000 Takahashi et al. ..... 399/144
6,462,839 B1 * 10/2002 Short ..... 358/474
6,768,893 B1 * 7/2004 Andersen et al. ..... 399/367
6,819,906 B1 11/2004 Herrmann et al.
2003/0090747 A1 * 5/2003 Fang et al. ..... 358/498
2005/0094218 A1 * 5/2005 Ando ..... 358/474
2005/0238397 A1 * 10/2005 Kitaoka et al. ..... 399/367

FOREIGN PATENT DOCUMENTS

JP 2002131852 A * 5/2002
JP 2005269450 A * 9/2005

* cited by examiner

*Primary Examiner*—Andrew H. Hirshfeld
*Assistant Examiner*—Dave A. Ghatt
(74) *Attorney, Agent, or Firm*—William A. Henry, II

(57) ABSTRACT

An improvement in a skew adjustment system used in correcting skew between a document handler and a scan tub includes curved slots in a base portion of the document handler that are positioned for rotation over protruding members projecting from the surface of a movable portion of a hinge connecting the document handler to the scan tub. Rotation of the document handler generates a virtual pivot point what will increase the angular adjustment between the scan tub and the document handler while minimizing the misalignments.

20 Claims, 4 Drawing Sheets

DOCUMENT HANDLER/SCAN TUB SKEW CORRECTION SYSTEM

This invention relates in general to an image forming apparatus, and more particularly, to an image forming apparatus employing an improved system for correcting skew between a document handler and a scan tub.

In printers, such as, in U.S. Pat. No. 6,819,906 issued to Douglas Herrmann et al. on Nov. 16, 2004, which is incorporated herein by reference, that employ document handling systems there is an increasing market demand for tighter skew performance. Typically, a large portion of skew is due to the alignment of the document handler to the scan tub, i.e., the squareness of a sheet with respect to the document handler and scan tub while the sheet is being scanned. When the skew requirements of a copier/printer are tighter than can be controlled through normal manufacturing tolerances, it is common to provide an adjustment feature at the mount points between the document handler, whether automatic, dedicated or recirculating and the scanning tub. As shown schematically in FIG. 4, the typical means of adjustment is to pivot the document handler on one mount pin at one end thereof, and slide another pin at the adjacent end thereof in a loose vertical slot. Use of this method of adjustment results in a lot of movement at one end of the document handler and very little at the other end. This presents a problem in that for the given limits on range of movement (i.e., allowable document handler cover misalignment, or roll to ramp clearance) the angular skew correction is not maximized.

For example, as seen in FIG. 4, document handler 10 has been rotated about pivot pin 11 in the direction of arrow 12 to pivot the document handler about a scan line 14 and center line 15 above scan tub 13. A vertical slot 17 in document handler 10 enables the rotation about pivot pin 11. Since the paper path at the scan line is split between the document handler and the scan tub, there is a physical limitation of how much the document handler can be rotated before the paper path is "pinched off". For this illustration, this is set as 1 mm. Experiment shows that maximum rotation of the document handler 10, with respect to scan tub 13, which is about 1 mm or 0.1560 about pin 11, creates a concomitant movement of approximately 5.3 mm at the end of the document handler diagonal from the end thereof that is adjacent pin 11. A reference base or width of a sheet is taken as 200 mm, as shown. The problem with this design is that for the given limits on the range of movement (e.g., cover misalignment or paper path to platen alignment) small angular adjustments are generated. Under certain tolerance conditions, this amount of angular adjustment is not sufficient.

Obviously, there is still a need for a reprographic device that increases angular movement between a document handler with respect to a scanning tub in order to thereby enhanced document skew performance of the machine.

Accordingly, an improved apparatus and method for maximizing document angular skew correction between a document handler and a scan tub is disclosed that includes a document handler with a base frame and a pair of curved slots positioned within adjacent ends of the base frame. A pair of curved members protrude from a portion of a counterbalance hinge and extend into the pair of curved slots, such that, pivoting of the document handler within the pair of slots ensures alignment of the document handler base frame with the scan tub.

The disclosed reprographic system that incorporates the disclosed improved document handler/scan tub skew correction system may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific embodiments, including the drawing figures (which are approximately to scale) wherein.

Figure 1:
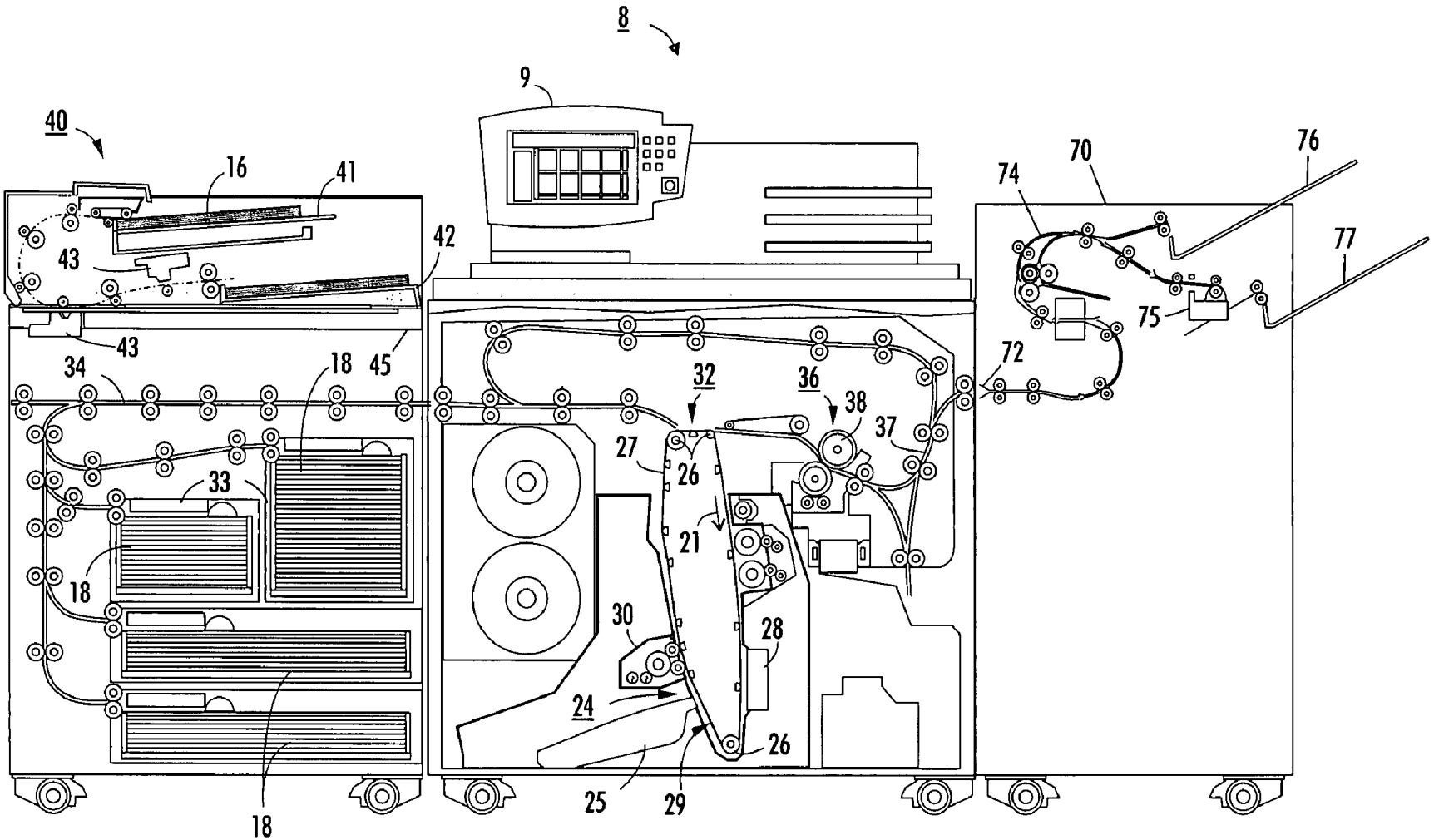
FIG. 1 is an exemplary modular xerographic printer that includes the improved system for document handler alignment of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved document handler/scan tub alignment adjustment apparatus.

For a general understanding of the features of the disclosure, reference is made to the drawings. In the drawings, like reference numerals have been used throughout to identify identical elements.

Referring to printer 8 of FIG. 1, as in other xerographic machines, an electronic document or an electronic or optical image of an original document or set of documents to be reproduced may be projected or scanned onto a charged surface 29 of a photoreceptor belt 27 to form an electrostatic latent image. Optionally, an automatic document feeder 40 (ADF) may be provided to scan at a scanning station 43 paper documents 16 fed from a tray 41 to a tray 42. The document handler or automatic document feeder 40 is clamshell connect by conventional hinges (not shown) to scan tub 45. The latent image is developed with developing material to form a toner image corresponding to the latent image. The toner image is then electrostatically transferred to a final print media material, such as, paper sheets 18, to which it may be permanently fixed by a fusing device 16. The machine user may enter the desired printing and finishing instructions through the graphic user interface (GUI) or control panel 9, or, with a job ticket, an electronic print job description from a remote source, or otherwise.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 8 in which the fuser structure apparatus is utilized.

The belt photoreceptor 27 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Paper trays 33 include trays adapted to feed the long edge of sheets first from a tray (LEF) or short edge first (SEF) in order to coincide with the LEF or SEF orientation of documents fed from tray 41 that is adapted to feed documents LEF or SEF depending on a user's desires. Transfer of the toner image to the sheet is effected and the sheet is stripped from the photoreceptor and conveyed to a fusing station 36 having fusing device 38 where the toner image is fused to the sheet. The sheet 18 is then transported by a sheet output transport 37 to the finishing station 70 where plural sheets 18 may be accumulated to be compiled into superposed sets or sheets and optionally fastened together (finished) by being stapled.

With further reference to FIG. 1, a simplified elevational view of a finisher module, generally indicated as 70, is shown printed sheets from the printer 8 are accepted in an entry port 72. Depending on the specific design of the finisher module 70, there may be numerous paths, such as, 74 and numerous output trays 76 for print sheets. It is to be understood that various rollers and other devices which contact and handle sheets within finisher module 70 are driven by various motors, solenoids and other electromechanical devices (not shown), under a control system, such as including a microprocessor (not shown), within the finisher module 70, printer 8, or elsewhere, in a manner generally familiar in the art.

Finisher 70 has a top tray 76 and a main tray 77. The top tray 76 is used as a purge destination, as well as, a destination for the simplest of jobs that require no finishing and no collated stacking. The main tray 76 has a pair of pass-through 100 sheet upside down staplers 75 and is used for most jobs that require stacking or stapling. Sheets that do not require stapling are forwarded along path 74 to top tray 76. Sheets that require stapling are forwarded along path 74, stapled at 75 and deposited into the main tray or lower tray of output trays 76. Conventional, spaced apart, staplers 75 are adapted to provide individual staple placement at either the inboard or outboard position of the sheets, as well as, the ability for dual stapling, where a staple is placed at both the inboard and outboard positions of the same sheets.

Figure 2:
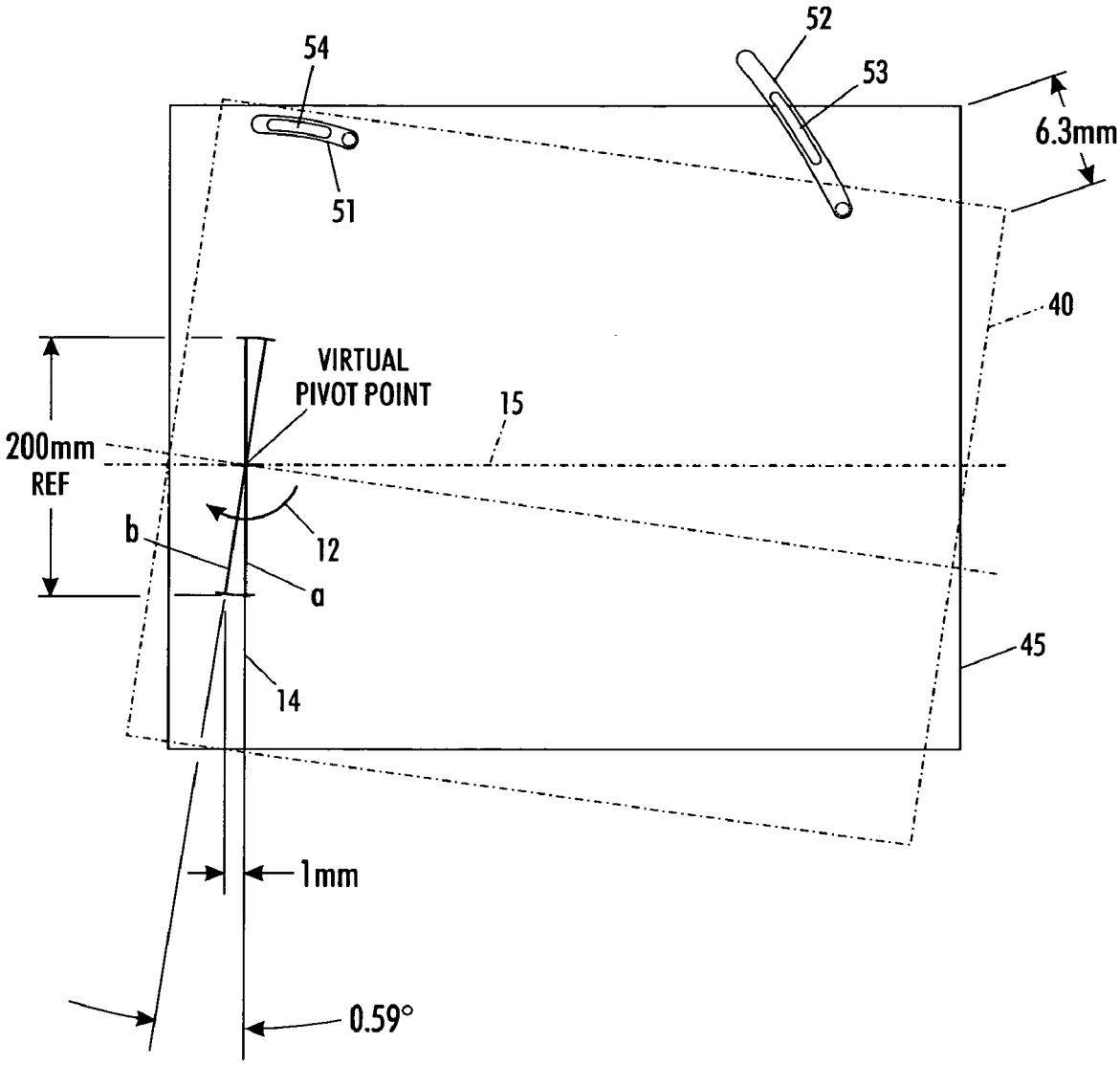
FIG. 2 is a partial schematic plan view of a one embodiment of the improved document handler alignment adjustment apparatus of the disclosure.
Figure 4:
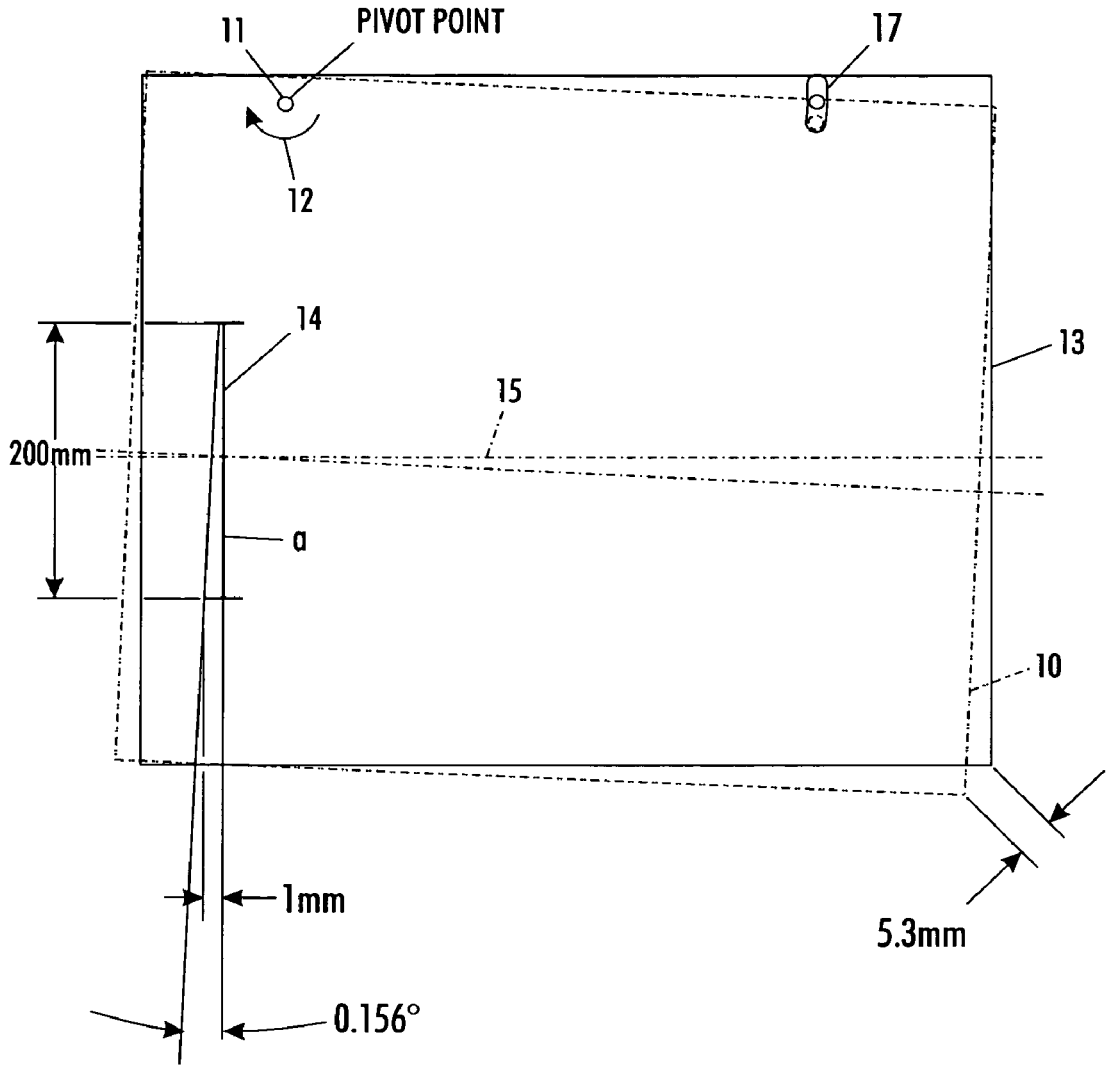
FIG. 4 PRIOR ART
FIG. 4 is a partial schematic plan view of a prior art skew adjustment technique.

One embodiment of the improved mechanism for adjusting the skew between document handler 40 and scanner tub 45 is disclosed in FIG. 2 and includes curved slots 51 and 52 in the base frame of document handler 10 and complimentary shaped protrusion members 54 and 53, respectively, that fit within the curved slots and enables the base frame of document handler 40 to rotate about a virtual pivot point close to one side of the document handler along center line 15 in the direction of arrow 12. Preferably, protrusion members 54 and 53 are built into a moveable portion of hinges (not shown) that facilitates document handler 40 being liftable clamshell style away from scan tub 45. Usually, in order to prevent damage to either the document handler or scan tub when the document handler is lowered onto the scan tub, a counterbalance mechanism (not shown) is built into each hinge as well. Curved slots 51 and 52 in conjunction with protrusion members 51 and 52 generate the virtual pivot point that increases the angular adjustment between scanner tub 45 and document handler 40 while minimizing any misalignment of documents. Maximum rotation of the document handler 40, with respect to scan tub 45 about 1 mm yields a 0.59° arc of rotation and creates a concomitant movement of approximately 6.3 mm. Hence, the range of skew correction available with the system of FIG. 2 is improved approximately four times over the skew correction scheme of FIG. 4 before a document is "pinched off."

Figure 3:
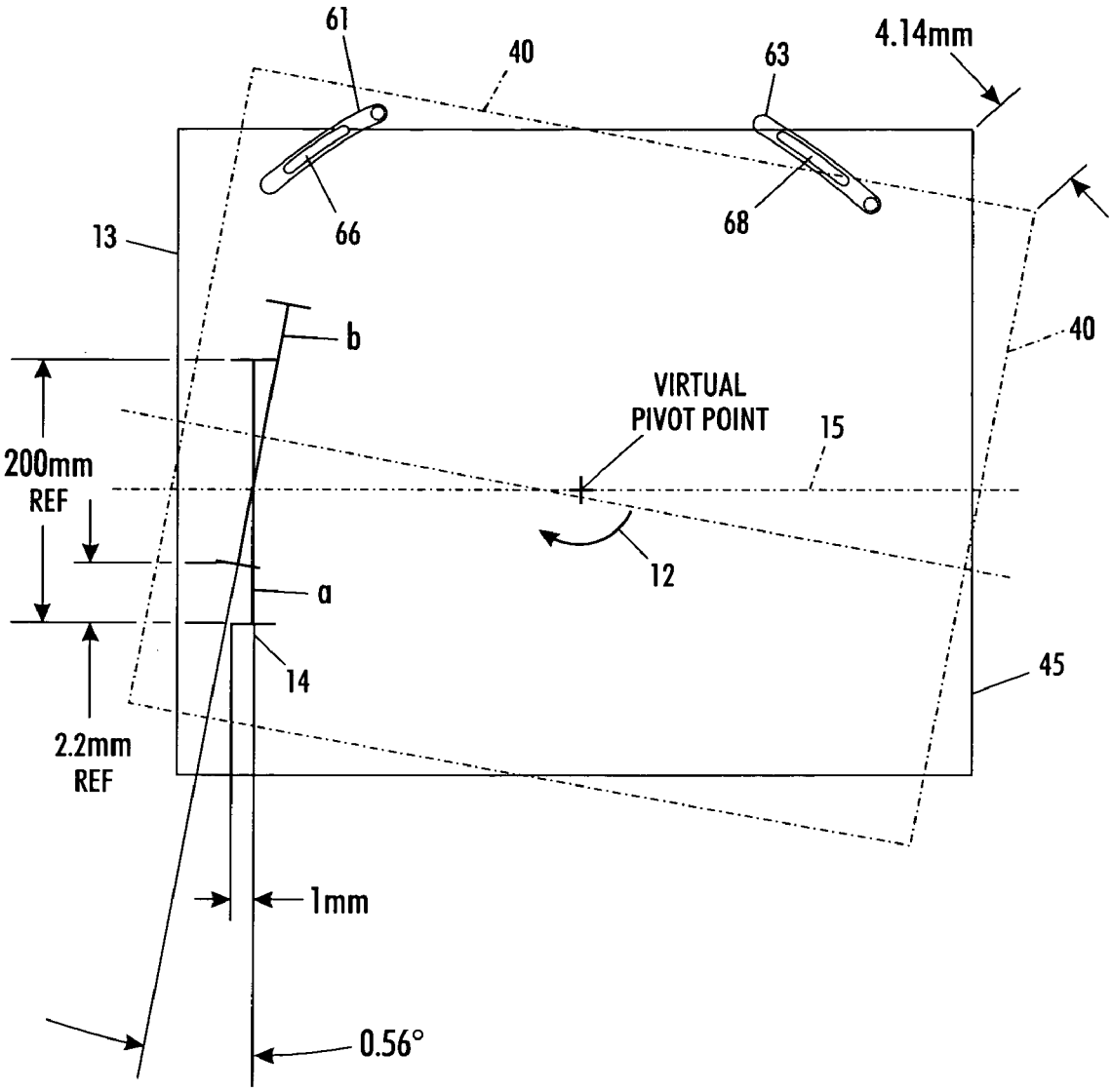
FIG. 3 is a partial schematic plan view of another embodiment of the improved document handler alignment adjustment apparatus of the disclosure.

FIG. 3 discloses yet another embodiment of an improvement to the skew adjustment mechanism between document handler 40 and scan tub 45. Here, curved slots 61 and 63 are positioned within the base of document handler 10 at angles that are different from those of FIG. 2 in order to increase skew adjustment latitude while simultaneously reducing document cover misalignment in the process. Document handler 40 is fitted clamshell style to scan tub 45 with a pair of hinges (not shown) that can include counterbalance members to dampen the closure force experienced when the document handler is closed onto scan tub 45. Mating members 66 and 68 are preferably molded into the movable portion of the hinges and are adapted to fit within slots 61 and 63, respectively. Rotation of document handler 40 and slots 61 and 63 along mating members 61 and 63 generates a virtual pivot point at about the center of a document that produces a maximum skew adjustment of 0.56° with only a 4.14 mm document handler cover misalignment. The 2.2 mm dimension is the vertical shift (or side edge registration) of the virtual pivot point on a sheet of paper when the virtual pivot point is located, as here, at the center of document handler 40. This registration could be fixed using a non-volatile memory setting. This vertical shift of the pivot point is negligible in FIG. 2. An advantage of this arrangement over the arrangement of FIG. 2 is that the cover misalignment is reduced by about 1/3 (6.3 mm vs 4.14 mm), while giving approximately the same skew correction.

It should now be understood that an improved apparatus and method has been disclosed for a skew adjustment mechanism that minimizes document handler cover misalignment or paper path to platen misalignment. The apparatus incorporates a pair of curved slots into the document handler base that mate with curved members that protrude from a surface of a movable portion of hinges that connect the document handler clamshell like to the scan tub. The curved slots allow movement of the document handler with respect to the scan tub, and the movement creates a virtual pivot point for that enables the document handler that in the process increases the angular adjustment available between the document handler and the scan tub while simultaneously minimizing the misalignments.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A reprographic device, comprising:

a document handler that receives and feeds documents from a feed tray along a predetermined feed path, said document handler including a base member;

a scan tub positioned beneath said base member of said document handler and within said predetermined paper path, said scan tub including a scanning member positioned to read an image on each document as it is passing and forwards image data for further processing;

an image processor that receives the image data from said scanning member and processing it;

a plurality of copy sheet feed trays adapted to feed copy sheets to receive images thereon from said image processor;

at least one output tray for receiving imaged copy sheets; and a skew adjustment mechanism for correcting misalignment between said document handler base member and said scan tub, including a pair of curved slots positioned within said base member and slidably mounted over a pair of protruding members positioned therebeneath.

2. The reprographic device of claim 1, wherein movement of said base member creates a virtual pivot point between said document handler and said scan tub.

3. The reprographic device of claim 2, wherein said virtual pivot point is positioned along a centerline of said scan tub.

4. The reprographic device of claim 3, wherein said virtual pivot point is located adjacent one end of said scan tub.

5. The reprographic device of claim 2, wherein said virtual pivot point is located in approximately the center of said scan tub.

6. The reprographic device of claim 5, wherein the range in arc of skew correction is about 0.56°.

7. The reprographic device of claim 1, wherein the range in arc of skew correction is about 0.59°.

8. A printing apparatus, comprising:

a document handler that receives and feeds documents from a feed tray along a predetermined feed path, said document handler including a base member;

a scan tub positioned beneath and mounted to said base member of said document handler and within said predetermined paper path, said scan tub including a scanning member positioned to read an image on each document as it is passing and forwards image data for further processing;

an image processor that receives the image data from said scanning member and processing it;

a plurality of copy sheet feed trays adapted to feed copy sheets to receive images thereon from said image processor;

at least one output tray for receiving imaged copy sheets; and a skew adjustment mechanism for correcting misalignment between said document handler base member and said scan tub, including a pair of curved slots positioned within said base member and slidably mounted over a pair of curved members protruding the mount of said scan tub to said base member.

9. The printing apparatus of claim 8, wherein movement of said base member creates a virtual pivot point between said document handler and said scan tub.

10. The printing apparatus of claim 9, wherein said virtual pivot point is positioned along a centerline of said scan tub.

11. The printing apparatus of claim 10, wherein said virtual pivot point is located adjacent one end of said scan tub.

12. The printing apparatus of claim 9, wherein said virtual pivot point is located in approximately the center of said scan tub.

13. The printing apparatus of claim 12, wherein the maximum range in arc of skew correction before a document is pinched off between said document handler and said scan tub is about 0.56°.

14. The printing apparatus of claim 8, wherein the range in arc of skew correction before a document is pinched off between said document handler and said scan tub is about 0.59°.

15. A method for correcting skew between a document handler and a scan tub, comprising:

providing a document handler that receives and feeds documents from a feed tray along a predetermined feed path, said document handler including a base member;

providing a scan tub positioned beneath said base member of said document handler and within said predetermined paper path, said scan tub including a scanning member positioned to read an image on each document as it is passing and forwards image data for further processing;

providing an image processor that receives the image data from said scanning member and processing it;

providing a plurality of copy sheet feed trays adapted to feed copy sheets to receive images thereon from said image processor;

providing at least one output tray for receiving imaged copy sheets; and providing a skew adjustment mechanism for correcting misalignment between said document handler base member and said scan tub, including a pair of curved slots positioned within said base member and slidably mounted over a pair of protruding members.

16. The method of claim 15, wherein movement of said base member creates a virtual pivot point between said document handler and said scan tub.

17. The method of claim 16, wherein said virtual pivot point is positioned along a centerline of said scan tub.

18. The method of claim 17, wherein said virtual pivot point is located adjacent one end of said scan tub.

19. The method of claim 16, wherein said virtual pivot point is located in approximately the center of said scan tub.

20. The method of claim 15, wherein the range in arc of skew correction before a document is pinched off between said document handler and said scan tub is about 0.59°.

* * * * *